US005140373A

United States Patent [19]

Ikegawa et al.

[11] Patent Number: 5,140,373

[45] Date of Patent: Aug. 18, 1992

[54] ELECTROSTATIC LATENT IMAGE DEVELOPING APPARATUS WITH BRISTLE HEIGHT ADJUSTING MEMBER

[75] Inventors: Akihito Ikegawa; Hiroshi Mizuno; Hiroshi Murasaki; Kouichi Etou, all of Osaka, Japan

[73] Assignee: Minolta Camera Kabushiki Kaisha, Osaka, Japan

[21] Appl. No.: 408,447

[22] Filed: Sep. 6, 1989

Related U.S. Application Data

[63] Continuation of Ser. No. 155,281, Feb. 12, 1988, abandoned.

[30] Foreign Application Priority Data

Feb. 13, 1987 [JP] Japan ..... 62-32046

[51] Int. Cl.[5] ..... G03G 15/09

[52] U.S. Cl. ..... 355/253; 118/657; 118/658

[58] Field of Search ..... 355/253, 251, 245, 261; 118/656, 657, 658, 653, 651

[56] References Cited

U.S. PATENT DOCUMENTS

| | | | |
|---|---|---|---|
| 3,572,922 | 3/1971 | Olden | 118/657 X |
| 4,102,306 | 7/1978 | Ohta | 118/658 |
| 4,237,819 | 12/1980 | Ikegami et al. | 118/658 |
| 4,284,702 | 8/1981 | Tabuchi et al. | 118/657 X |
| 4,378,158 | 3/1983 | Kanbe | 118/651 X |
| 4,421,057 | 12/1983 | Hosono et al. | 118/657 |
| 4,435,065 | 3/1984 | Wada | 355/245 |
| 4,482,244 | 11/1984 | Yamazaki et al. | 355/3 DD X |
| 4,615,606 | 10/1986 | Nishikawa | 118/658 X |
| 4,676,192 | 6/1987 | Yuge et al. | 118/658 |
| 4,786,936 | 11/1988 | Ikegawa et al. | 355/253 |
| 4,809,034 | 2/1989 | Murasaki et al. | 355/253 |

FOREIGN PATENT DOCUMENTS

| | | | |
|---|---|---|---|
| 0115576 | 7/1982 | Japan | 355/3 DD |

*Primary Examiner*—A. T. Grimley
*Assistant Examiner*—Robert Beatty
*Attorney, Agent, or Firm*—Burns, Doane, Swecker & Mathis

[57] ABSTRACT

A developing apparatus is accommodated in an image forming apparatus to develop an electrostatic laten image formed on an electrostatic latent image support member, using two-component developer of toner and magnetic carrier. The developing apparatus is provided with a developing sleeve opposed to the electrostatic latent image support member, a magnetic roller disposed inside the developing sleeve to hold the carrier on a peripheral surface of the developing sleeve, a toner hopper accommodating the toner and having an opening at its one end, a toner supply roller rotatably disposed in the opening of the toner hopper and opposed to the developing sleeve, a bristle height adjusting member opposed to the developing sleeve on the downstream side of a developing region and on the upstream side of a toner supply region in a direction of movement of the carrier held on the peripheral surface of the developing sleeve. The developing sleeve confronts the electrostatic latent image support member in the developing region and the toner supply roller in the toner supply region.

11 Claims, 4 Drawing Sheets

ELECTROSTATIC LATENT IMAGE DEVELOPING APPARATUS WITH BRISTLE HEIGHT ADJUSTING MEMBER

This application is a continuation of application Ser. No. 155,281, filed Feb. 12, 1988 now abandoned.

BACKGROUND OF THE INVENTION

1. Field of the Invention

The present invention relates to a developing apparatus for use in an image forming apparatus such as a copying apparatus or the like.

2. Description of the Prior Art

An electrostatic latent image developing apparatus is generally provided with a developing sleeve accommodating a plurality of magnets and a toner supply roller having a large number of fine concave portions formed in its surface. Two-component developer consisting of toner and carrier is often employed in this kind of developing apparatus. The toner is supplied from the toner supply roller with respect to the carrier magnetically held on the peripheral surface of the developing sleeve. The toner and the carrier are mixed and stirred on the surface of the developing sleeve so that they may be electrostatically charged with opposite polarity. In this way, the developer is properly adjusted and is then brought into contact with an electrostatic latent image formed on an electrostatic latent image support member so that the charged toner may be electrostatically supplied onto the electrostatic latent image.

In this kind of developing apparatus, the toner is initially supplied onto the developing sleeve in a toner supply region in which the developing sleeve and the toner supply roller confront each other. At this instance, the toner is required to be raised in electrical charge up to a level suitable for the development by bringing it into frictional contact with the carrier satisfactorily, until it is transported into a developing region in which the developing sleeve and the electrostatic latent image support member confront each other.

To this end, a bristle height adjusting member confronting the peripheral surface of the developing sleeve is generally provided on the way from the toner supply region to the developing region. The developer, being transported with the rotation of the developing sleeve, is thus fully mixed and stirred at a location before the bristle height adjusting member.

The height of brush bristles of the developer is adjusted by the bristle height adjusting member. However, the developer, once adjusted in height, is caused to rotate, since it is pushed by other developer being fed thereafter, thus resulting in that the developer once adjusted in height discontinuously comes into contact with that held on the developing sleeve. Consequently, some signs of stirring of the developer appear on the surface of the developing sleeve and result disadvantageously in unevenness of image density.

To steadily obtain the image in nearly fixed density, it is necessary to replenish the toner onto the surface of the developing sleeve by an amount thereof corresponding to that consumed in the developing region. Particularly, in the case where some image having many a solid portion is repeatedly successively copied, a large amount of toner is consumed and the amount of toner to be replenished is therefore relatively large.

However, if the fine concave portions formed in the surface of the toner supply roller are increased in size so that the toner may be completely replenished only in the toner supply region, the toner is excessively supplied in the case of developing the ordinary literal image. As a result, uncharged toner turns into powder and often adheres to the surface of the electrostatic latent image support member to produce fog around the image or to bring contamination inside the apparatus.

SUMMARY OF THE INVENTION

Accordingly, the present invention has been developed with a view to substantially eliminating the above described disadvantages inherent in the prior art developing apparatus, and has for its essential object to provide an improved developing apparatus, whereby a uniform image can be obtained without any unevenness in density.

Another important object of the present invention is to provide a developing apparatus of the above described type which is simple in construction and stable in functioning and, can be readily manufactured at a low cost.

In accomplishing these and other objects, a developing apparatus of the present invention is provided with a developing sleeve opposed to an electrostatic latent image support member on which an electrostatic latent image is formed, a magnetic roller disposed inside the developing sleeve to hold magnetic carrier on a peripheral surface of the developing sleeve, a toner hopper accommodating toner and having an opening at its one end, a toner supply roller rotatably disposed in the opening of the toner hopper and opposed to the developing sleeve, a bristle height adjusting member opposed to the developing sleeve on the downstream side of a developing region and on the upstream side of a toner supply region in a direction of movement of the carrier held on the peripheral surface of the developing sleeve. The developing sleeve confronts the electrostatic latent image support member in the developing region and the toner supply roller in the toner supply region.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and in which.

DETAILED DESCRIPTION OF THE PREFERRED EMBODIMENT

Figure 1:
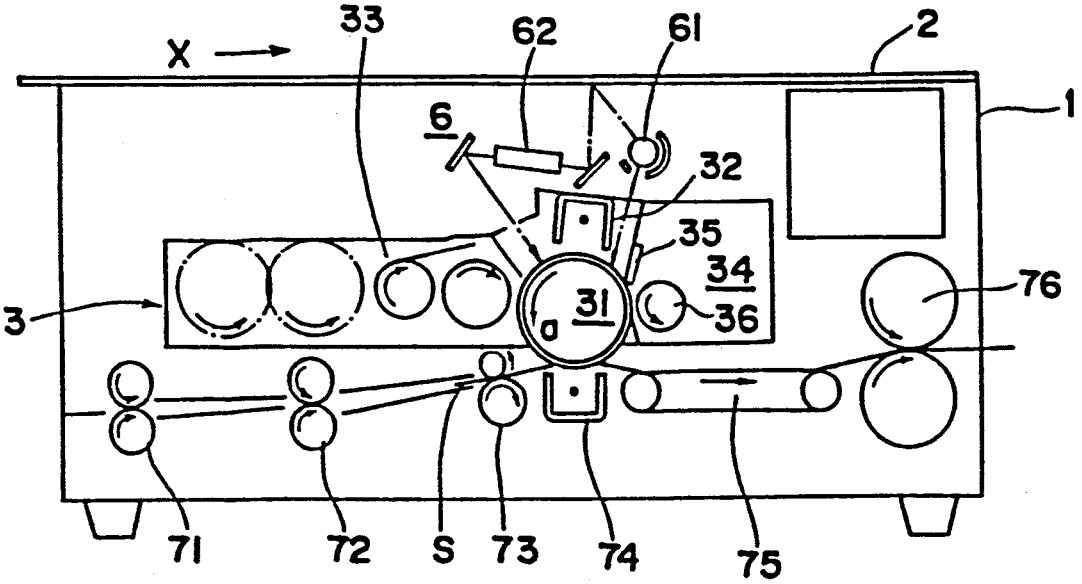
FIG. 1 is a schematic sectional view of a copying apparatus employing therein a developing apparatus of the present invention.

Referring first to FIG. 1, a copying apparatus, generally shown by 1, is internally provided with an image forming unit 3 provided with a developing apparatus 33 according to one preferred embodiment of the present invention.

When a print switch (not shown) has been initially turned on, an electrostatic latent image support member or a photoreceptor drum 31 located substantially at a central portion of a housing 1 of the copying apparatus is rotated in a direction as shown by an arrow (a). In this event, the surface of the photoreceptor drum 31 is uniformly electrostatically charged through electrical discharge of a charger 32.

An original glass plate 2 on which an original document (not shown) has been placed scans in a direction of an arrow (X). Light emitted from an exposure lamp 61 of an optical system 6 is applied to the original document and is reflected thereby to be directed to the surface of the charged photoreceptor drum 31 through mirrors and a bundle of optical fibers 62 so that the electrostatic latent image corresponding to the image of the original document may be formed on the surface of the photoreceptor drum 31. The bundle of optical fibers 62 are commercially available under a trade name "SELFOC".

The electrostatic latent image is developed at a location confronting the developing apparatus 33 which forms a toner image corresponding to the image of the original document.

A copy paper sheet S is supplied from a paper supply portion (not shown) and transported by pairs of transport rollers 71 and 72 towards a pair of timing rollers 73 which further transport the copy paper sheet S at desired timing towards a location in which the photoreceptor drum 31 and a transfer charger 74 are opposed to each other. The aforementioned toner image is then transferred onto the copy paper sheet through electrical discharge from the transfer charger 74.

Upon separation of the copy paper sheet S from the surface of the photoreceptor drum 31 by a suitable means, the copy paper sheet S is further transported between a pair of fixing rollers 76 by a belt 75. After the toner has been fused and fixed onto the copy paper sheet S by the fixing rollers 76, the copy paper sheet S is discharged to a paper discharge portion (not shown).

As to the photoreceptor drum 31, residual toner is scraped off, by a cleaning blade 35 of a cleaning device 34, from the surface thereof from which the toner image has been transferred. Furthermore, the light from the exposure lamp 61 is again applied to the surface of the photoreceptor drum 31 so that the remaining electric charge may be erased therefrom for the next development. The toner scraped off by the cleaning blade 35 is collected by a collecting roller 36.

Figure 2:
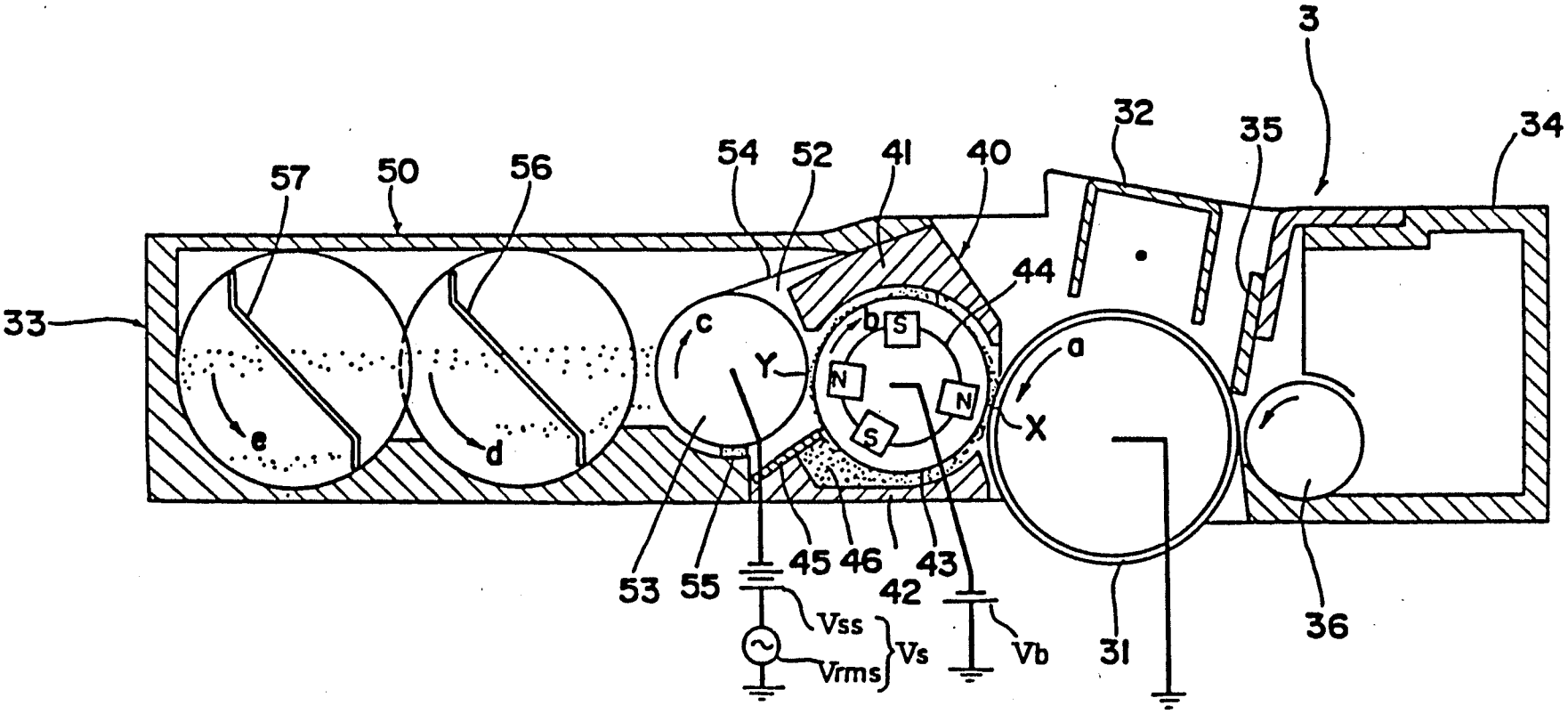
FIG. 2 is a sectional view of an image forming unit provided with the developing apparatus of the present invention.
Figure 3:
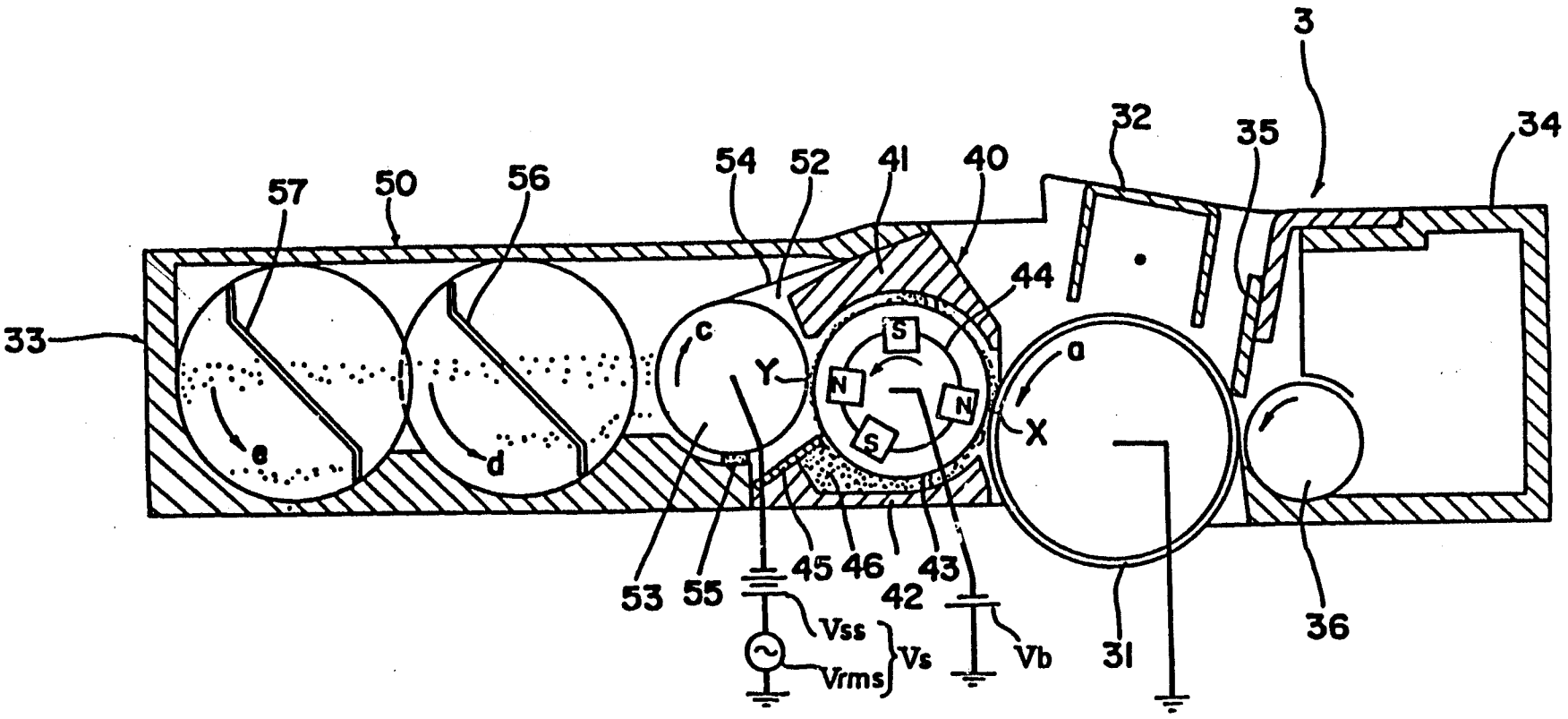
FIG. 3 is a sectional view of an image forming unit provided with the developing apparatus of the present invention illustrating the rotational direction of the magnetic roller 44.
Figure 4:
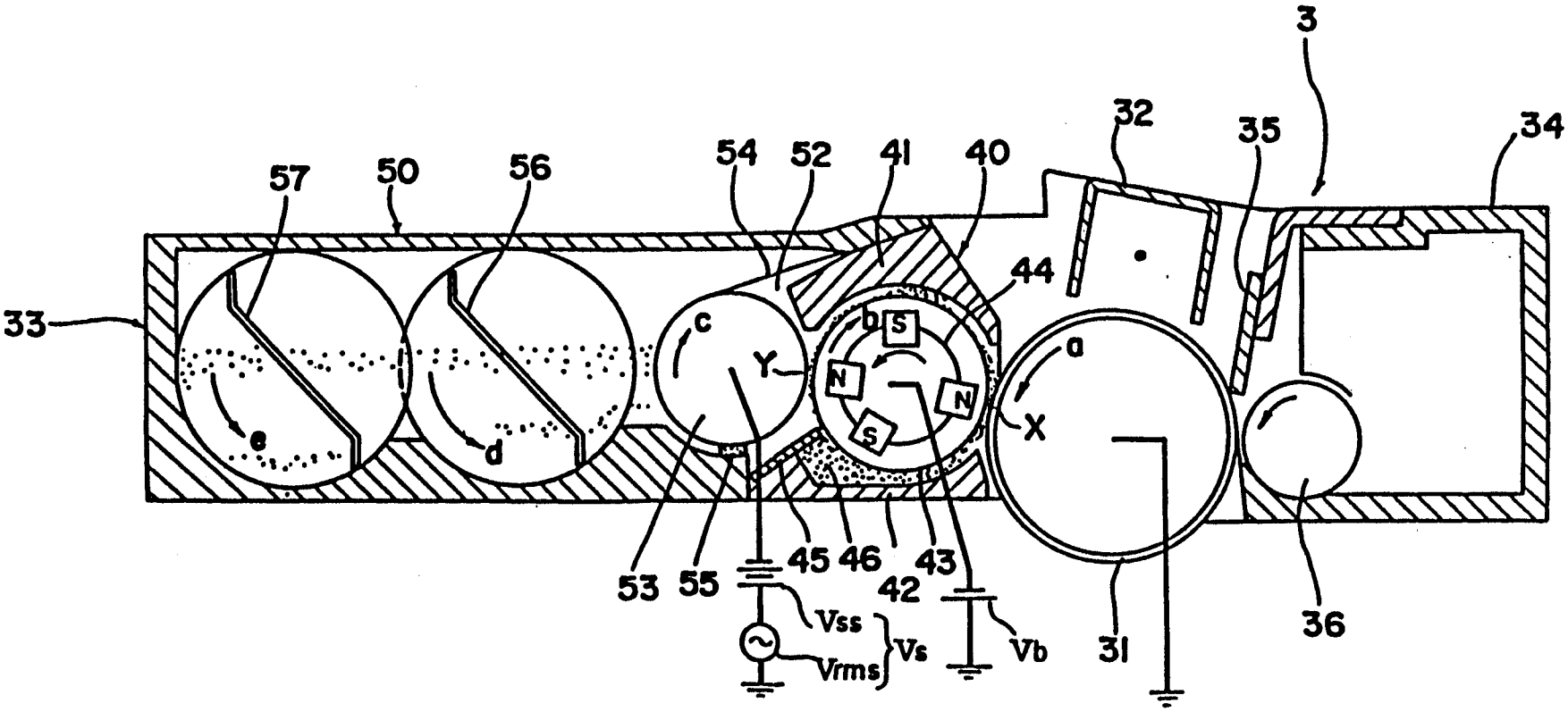
FIG. 4 is a sectional view of an image forming unit provided with the developing apparatus of the present invention showing the rotational direction of all the rotating components.

With reference to FIG. 2, the developing apparatus 33 according to one preferred embodiment of the present invention will be explained hereinafter.

The developing apparatus 33 together with the photoreceptor drum 31, the charger 32 and the cleaning device 34 constitutes the image forming unit 3 which is removably mounted in the housing 1 of the copying apparatus. The photoreceptor drum 31 is electrically grounded.

The developing apparatus 33 generally comprises a developing portion 40 and a toner hopper 50. The toner hopper 50 is removably disposed with respect to the developing portion 40 and can be replaced by another hopper accommodating differently colored toner as occasion demands.

The developing portion 40 accommodates a developing sleeve 43 inside its casing, that is, in a space defined by an upper frame 41, a lower frame 42 and side frames (not shown). The developing sleeve 43 is rotatable in a direction as shown by an arrow (b) and confronts the photoreceptor drum 31 at a predetermined interval of 0.7 mm.

A magnetic roller 44 is fixedly mounted inside the developing sleeve 43 and is internally provided with a plurality of magnets, each of which extends its magnetic poles in a direction of axis of the magnetic roller 44. The magnetic poles S and N are alternately disposed along the periphery of the magnetic roller 44. Developing bias voltage Vb is applied to the developing sleeve 43.

A bristle height adjusting member 45 is fixedly mounted on the lower frame 42, and its forward end confronts the peripheral surface of the developing sleeve 43 at a predetermined interval of 0.4 mm at an oblique lower portion on the side opposite to the photoreceptor drum 31. A developer storing portion 46 is formed on the upstream side of the bristle height adjusting member 45 in a direction of rotation of the developing sleeve 43.

A toner supply roller 53 is disposed in an opening 52 formed in the toner hopper 50 on the side of the developing portion 40 and is rotatable in a direction of an arrow (c). The toner supply roller 53 is opposed to the developing sleeve 43 at a predetermined interval of 0.6 mm. A non-magnetic restriction blade 54 and a toner scattering prevention member 55 are mounted at upper and lower portions of the opening 52 respectively, under pressure with respect to the peripheral surface of the toner supply roller 53 so that the opening 52 may be substantially closed.

The peripheral surface of the toner supply roller 53 is formed finely unevenly through blast-treatment, etching or the like. Collecting bias voltage Vs obtained by connecting direct current voltage Vss and alternating voltage Vrms in series is applied to the toner supply roller 53.

Behind the toner supply roller 53 is provided two transport vanes 56 and 57 juxtaposed with each other and disposed rotatably in the same direction as shown by arrows (d) and (e), respectively.

The toner is accommodated inside the toner hopper 50, whereas two-component developer is held on the outer periphery of the developing sleeve 43 and stored in the developer storing portion 46. The developer is of the magnetic carrier mixed with the toner at the rate of 8 wt%.

The toner and the carrier are so selected as to be electrostatically charged with positive and negative polarity, respectively, through their frictional contact.

In the developing apparatus 33 having the above described construction, the developing sleeve 43, the toner supply roller 53 and the transport vanes 56 and 57 rotate in the directions of the arrows (t), (c), (d) and (e), respectively, at the beginning of copying operation.

The toner stored in the toner hopper 50 is transported towards the toner supply roller 53 with the rotation of the transport vanes 56 and 57 so as to be caught in a great number of fine concave portions formed in the surface of the toner supply roller 53.

The toner held on the surface of the toner supply roller 53 is further transported with the rotation thereof in the direction of the arrow (c). Excessive toner is scraped down from the toner supply roller 53 at a location pressed by the restriction blade 54. In this event, the toner is electrostatically charged through the friction with the restriction blade 54 and is transported into a toner supply region Y in such a fashion as one or two layers of thin films. In the toner supply region Y, the developing sleeve 43 and the toner supply roller 53 are opposed to each other.

On the other hand, the developer is held in a state of a magnetic brush on the outer periphery of the developing sleeve 43 along magnetic lines of force produced by the magnets of the magnetic roller 44. The toner transported by the toner supply roller 53 is caught by the magnetic brush in the toner supply region Y.

Since the bias voltage Vs obtained by connecting the direct current voltage Vss and the alternating voltage Vrms in series is applied to the toner supply roller 53, vibrating electrical field arises in the toner supply region Y, and therefore, both the toner and the developer vibrate. As a result, the magnetic brush and the toner are frequently brought into contact with each other so that the toner may be effectively supplied onto the surface of the developing sleeve 43.

When the toner caught by the magnetic brush is transported in the direction of the arrow (b) with the rotation of the developing sleeve 43, it comes into contact with the carrier so as to be further raised in its electrostatic potential. The toner is thus electrostatically supplied, in a developing region X, onto the electrostatic latent image formed on the surface of the photoreceptor drum 31, since the developing sleeve 43 and the photoreceptor drum 31 are opposed to each other in the developing region X.

The developer having passed through the developing region X is further transported in the direction of the arrow (b) and the majority thereof is scraped down from the surface of the developing sleeve 43 at a location confronting the bristle height adjusting member 45.

The developer scraped down is mixed with other developer stored in the developer storing portion 46. A part of the developer is held on the surface of the developing sleeve 43 under the influence of magnetic force of the magnetic roller 44 and is transported into the toner supply region Y by way of the location confronting the bristle height adjusting member 45.

The fact that the toner contained in the developer is consumed in the developing region X produces a partial difference in developer density in the developer layer formed on the developing sleeve 43 (referred to as a consumed pattern hereinafter). This consumed pattern is, however, erased by being mixed and stirred with the developer stored in the developer storing portion 46. Consequently, although the density of the developer layer held on the developing sleeve 43 is lowered as a whole, it is leveled.

The toner is replenished, in the toner supply region, with respect to all over the surface of the developer layer by an amount corresponding to the amount consumed. Thus, the developer layer having the predetermined density is uniformly formed on the surface of the developing sleeve 43, at the time when it has passed through the toner supply region Y.

Accordingly, even if any image having many a solid portion is repeatedly copied, the consumed pattern is initially mixed and stirred with the developer in the developer storing portion 46 so that the density of the developer held on the developing sleeve 43 may be leveled. Thereafter, insufficient amount of the toner is replenished in the toner supply region Y. The ability of the toner supply roller 53 is, therefore, sufficient enough for supplying the toner, if only the toner supply roller 53 can supply the toner by an amount to be consumed during the development of an ordinary image.

Even if the developer layer is uneven in density after having passed through the bristle height adjusting member 45, it is erased by the toner to be supplied in the toner supply region Y. As a result, the developer clear from the unevenness in density is supplied into the developing region X in nearly fixed density so that the toner may be uniformly supplied onto the electrostatic latent image.

As shown in FIG. 2, the developer is transported into the toner supply region Y along the lower surface of the developing sleeve 43 after having passed through the developing region X. At a certain location during this, the bristle height adjusting member 45 is caused to confront the developing sleeve 43. The present invention is not limited by the above described arrangement, and if the developing sleeve 43 rotates in a direction opposite to the direction of the arrow (b), the bristle height adjusting member 45 may be caused to confront the upper surface of the developing sleeve 43.

However, if the developer storing portion 46 is formed below the developing sleeve 43 as in the foregoing embodiment, not only the developing sleeve 43 hardly receives the weight of the developer, but also the developer never clogs between the bristle height adjusting member 45 and the developing sleeve 43. Accordingly, this embodiment is advantageous in that torque required for rotating the developing sleeve 43 never be increased.

As clearly shown above, in the developing apparatus according to the present invention, the developer storing portion is formed by providing the bristle height adjusting member confronting the developing sleeve on the way from the developing region to the toner supply region. In this developer storing portion, the two-component developer of the toner and the carrier fully mixed with each other is replenished on the surface of the developing sleeve. Thereafter, the toner is further replenished by an amount of shortage in the toner supply region.

Accordingly, even if the toner density is uneven when the toner passes the location confronting the bristle height adjusting member, the unevenness of the density is cleared by the toner to be replenished in the toner supply region. Therefore, the developer is uniformly supplied into the developing region always in nearly fixed density, and thus, the image can be uniformly obtained without any unevenness of the density.

Moreover, even if an original document is repeatedly successively copied, the pattern of consumed toner is erased on the developing sleeve in such a way that the developer density on the developing sleeve is leveled in the developer storing portion and insufficient amount of the toner is then replenished in the toner supply region. Accordingly, it is not necessary to partially replenish a large amount of toner only in the toner supply region, and therefore, the ability of the toner supply roller for supplying the toner is not required to be raised.

It is to be noted that although there are provided a rotatably arranged developing sleeve and a fixedly arranged magnetic roller in this embodiment, both or either one of them may be arranged rotatably.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A developing apparatus for use in an image forming apparatus with an electrostatic latent image support member on which an electrostatic latent image is formed, said developing apparatus comprising:

a developing sleeve opposed to the electrostatic latent image support member to define a developing region;

a magnetic means disposed inside said developing sleeve, for holding magnetic carrier on a peripheral surface of said developing sleeve;

a toner accommodating means accommodating toner therein and provided with an opening;

a toner supply means disposed at the opening of said toner accommodating means and opposed to said developing sleeve to define a toner supply region; and a bristle height adjusting member having a tip portion opposed to said developing sleeve with a predetermined gap on the downstream side of the developing region and on the upstream side of the toner supply region in a direction of movement of the carrier held on the peripheral surface of said developing sleeve for adjusting height of a developer comprising toner and the carrier on the surface of the developing sleeve to a predetermined height determined by said gap between said bristle height adjusting member tip portion and said developing sleeve, said bristle height adjusting member forming a developer storing portion wherein a developer scraped by the bristle height adjusting member is stored in order to be stirred.

2. A developing apparatus as claimed in claim 1, further comprises means for forming a voltage difference between said developing sleeve and said toner supply means.

3. A developing apparatus as claimed in claim 2, wherein said voltage difference forming means applies direct current voltage connected to alternating voltage in series to said toner supply means.

4. A developing apparatus as claimed in claim 1, wherein said bristle height adjusting member is fixedly mounted on a casing enclosing said developing sleeve, said casing forming a void space on the upstream side of said bristle height adjusting member in a direction of movement of the carrier held on said developing sleeve.

5. A developing apparatus as claimed in claim 1, wherein some toner on said toner supply means is brought into contact with the carrier held on said developing sleeve.

6. A developing apparatus as claimed in claim 1, wherein said bristle height adjusting member is located to confront the developing sleeve during movement of the sleeve from the developing region to the toner supply region.

7. A developing apparatus as claimed in claim 1, wherein said developing sleeve is arranged rotatably and said magnetic means is arranged fixedly.

8. A developing apparatus as claimed in claim 1, wherein said developing sleeve is arranged fixedly and said magnetic means is arranged rotatably.

9. A developing apparatus as claimed in claim , wherein both of said developing sleeve and said magnetic means are arranged rotatably.

10. In a developing apparatus comprising a developing sleeve confronting a photoreceptor having a surface on which an electrostatic latent image is formed to be developed with a toner and a carrier transported by said developing sleeve, a method comprising the steps of:

supplying a predetermined amount of the developer to said developer sleeve at a supplying portion;

developing the electrostatic latent image formed on the photoreceptor by means of the developer on the developing sleeve at a developing region;

adjusting a height of the developer and scraping some of the developer on the surface of the developing sleeve after developing by providing a bristle height adjusting member upstream to the supplying region and downstream to the developing region such that said bristle height adjusting member creates a gap between a tip portion of the bristle height adjusting member and the surface of the developing sleeve;

scraping some developer on the surface of the developing sleeve after developing by said bristle height adjusting member;

storing the developer scraped by the bristle height adjusting member in a developer storing portion formed between the developing region and the bristle height adjusting member; and stirring the scraped developer in the developer storing portion.

11. A method as claimed in claim 10 further comprising the step of:

contacting the photoreceptor with the developer supplied by supplying means after adjusting the height of said developer to the predetermined height.

* * * * *

US005140374A

United States Patent [19]

Jagielski et al.

[11] Patent Number: 5,140,374

[45] Date of Patent: Aug. 18, 1992

[54] READER PRINTER

[75] Inventors: David Jagielski, West Bend; Wojciech Dabrowski, Milwaukee; Paul Hanke, Leroy, all of Wis.

[73] Assignee: Anacomp Corporation, Indianapolis, Ind.

[21] Appl. No.: 776,841

[22] Filed: Oct. 15, 1991

[51] Int. Cl.[5] ..... G03G 21/00

[52] U.S. Cl. ..... 355/271; 355/45

[58] Field of Search ..... 355/271, 233, 235, 43, 355/44, 66, 60, 45; 353/21

[56] References Cited

U.S. PATENT DOCUMENTS

| | | | |
|---|---|---|---|
| 4,411,513 | 10/1983 | James | 355/271 |
| 4,494,859 | 1/1985 | Frias et al. | 355/271 |
| 4,593,996 | 6/1986 | Kubono | 355/271 |
| 4,648,707 | 3/1987 | Tanasescu | 355/45 |
| 4,738,523 | 4/1988 | Ito et al. | 355/45 X |
| 4,751,553 | 6/1988 | Fukasawa | 355/45 |
| 4,783,685 | 11/1988 | Kahle | 355/271 X |
| 4,873,552 | 10/1989 | Otsuki | 355/271 |
| 4,967,235 | 10/1990 | Sanbayashi | 355/271 |

FOREIGN PATENT DOCUMENTS

| | | | |
|---|---|---|---|
| 62-242927 | 10/1987 | Japan | 355/271 |
| 63-121038 | 5/1988 | Japan | 355/271 |
| 63-249139 | 10/1988 | Japan | 355/271 |
| 1-161332 | 6/1989 | Japan | 355/271 |
| 1-172846 | 7/1989 | Japan | 355/271 |

*Primary Examiner*—R. L. Moses
*Attorney, Agent, or Firm*—Mason, Kolehmainen, Rathburn, & Wyss

[57] ABSTRACT

A reader printer apparatus includes a modular housing formed by structural foam molding which includes an integrally formed means for carrying the various components of a reader printer apparatus. By providing an integrally formed carrying means, the need for a separate metal chassis and brackets is eliminated, thus reducing the number of parts required. Additionally, this allows the weight of the machine to be reduced to a value less than the seventy pound limit to enable the machine to be shipped by relatively less expensive small package carriers. The reader printer apparatus in accordance with the present invention includes a scanning assembly located relatively close to the object plane in order to reduce the overall size of the machine. Moreover, by locating adjacent scanning assembly adjacent to the object plane, the optical paths for the printing mode and the viewing mode are virtually independent, thus obviating the need for pivotally mounted viewing mirrors. The scanning assembly includes a pivotally mounted print mirror driven by a stepper motor synchronized to the speed of the print engine by a stepper motor, mechanically independent from the print engine. This reduces distortions in prints due to wear and voltage fluctuations relative to the print engine.

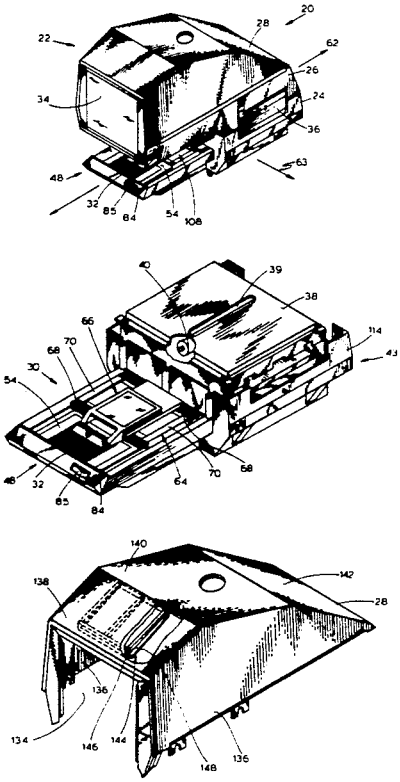

29 Claims, 10 Drawing Sheets